US010219673B2

(12) United States Patent
Kellis et al.

(10) Patent No.: US 10,219,673 B2
(45) Date of Patent: Mar. 5, 2019

(54) SURFACE CLEANING APPARATUS

(71) Applicant: BISSELL Homecare, Inc., Grand Rapids, MI (US)

(72) Inventors: Jay M. Kellis, Grand Rapids, MI (US); Kevin Haley, Byron Center, MI (US); Jeffrey A. Scholten, Ada, MI (US); Joseph Michael White, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 193 days.

(21) Appl. No.: 15/242,934

(22) Filed: Aug. 22, 2016

(65) Prior Publication Data

US 2016/0353963 A1 Dec. 8, 2016

Related U.S. Application Data

(63) Continuation of application No. 13/836,630, filed on Mar. 15, 2013, now Pat. No. 9,420,933, which is a (Continued)

(51) Int. Cl.

*A47L 11/34* (2006.01)
*A47L 13/17* (2006.01)

(Continued)

(52) U.S. Cl.

CPC ..... *A47L 13/225* (2013.01); *A47L 11/34* (2013.01); *A47L 13/17* (2013.01); *C11D 1/146* (2013.01);

(Continued)

(58) Field of Classification Search

CPC ..... A47L 11/34; A47L 13/17; A47L 13/225; C11D 1/146; C11D 3/3942; C11D 3/50; C11D 17/049

(Continued)

(56) References Cited

U.S. PATENT DOCUMENTS 2,571,575 A 10/1951 Holmes
5,002,684 A 3/1991 Beck et al.

(Continued)

FOREIGN PATENT DOCUMENTS

CN 2482956 Y 3/2002
CN 1371441 A 9/2002

(Continued)

OTHER PUBLICATIONS

Chen Zhu, Notification of the First Office Action, dated Aug. 3, 2016, 7 pages, The State Intellectual Property Office of the People's Republic of China.

(Continued)

*Primary Examiner* — Levon J Shahinian
(74) *Attorney, Agent, or Firm* — McGarry Bair PC

(57) ABSTRACT

A surface cleaning apparatus, and in particular a steam mop, comprises a steam generator and a steam outlet fluidly connected to the steam generator to deliver steam to a floor surface. Steam from the steam generator can be applied to a cleaning composition applied to a stain on the floor surface. The cleaning composition can be applied directly to the floor surface, or indirectly via a cleaning pad.

16 Claims, 5 Drawing Sheets

Related U.S. Application Data continuation-in-part of application No. 13/323,286, filed on Dec. 12, 2011, now Pat. No. 8,927,480.

(60) Provisional application No. 61/655,289, filed on Jun. 4, 2012.

(51) Int. Cl.

| | |
|---|---|
| ***A47L 13/22*** | (2006.01) |
| ***C11D 1/14*** | (2006.01) |
| ***C11D 3/39*** | (2006.01) |
| ***C11D 3/50*** | (2006.01) |
| ***C11D 17/04*** | (2006.01) |

(52) U.S. Cl.
CPC ..... *C11D 3/3942* (2013.01); *C11D 3/50* (2013.01); *C11D 17/049* (2013.01)

(58) Field of Classification Search
USPC ..... 15/104.93, 302, 320; 134/105, 198; 510/281
See application file for complete search history.

(56) References Cited

U.S. PATENT DOCUMENTS

| | | | | |
|---|---|---|---|---|
| 5,500,977 | A | 3/1996 | McAllise et al. | |
| 5,502,872 | A | 4/1996 | Chae et al. | |
| 5,786,317 | A | 7/1998 | Townsend | |
| 6,048,368 | A | 4/2000 | Ticheou et al. | |
| 6,131,237 | A | 10/2000 | Kasper et al. | |
| 6,584,990 | B2 | 7/2003 | Shaw | |
| 6,658,692 | B2 | 12/2003 | Lenkiewicz et al. | |
| 6,833,342 | B2 | 12/2004 | Woo et al. | |
| 7,048,458 | B2 | 5/2006 | Hall et al. | |
| 7,048,804 | B2 | 5/2006 | Kisela et al. | |
| 7,144,173 | B2 | 12/2006 | Policicchio et al. | |
| 7,475,448 | B2 | 1/2009 | Rosenzweig et al. | |
| 7,687,450 | B2 | 3/2010 | Li et al. | |
| 7,718,593 | B2 | 5/2010 | Micciche et al. | |
| 7,752,705 | B2 | 7/2010 | McDowell et al. | |
| 7,795,200 | B2 | 9/2010 | Durrant | |
| 7,849,556 | B1 | 12/2010 | Jansen | |
| 8,136,274 | B2 | 3/2012 | Sunder et al. | |
| 2002/0112744 | A1 | 8/2002 | Besseling | |
| 2003/0070692 | A1 | 4/2003 | Smith et al. | |
| 2004/0128786 | A1* | 7/2004 | Policicchio | A47L 13/20 15/228 |
| 2005/0022333 | A1 | 2/2005 | McDowell et al. | |
| 2005/0181966 | A1 | 8/2005 | Micciche et al. | |
| 2007/0134045 | A1* | 6/2007 | Holt | A47L 13/17 401/7 |
| 2008/0222835 | A1 | 9/2008 | Carruba | |
| 2009/0183334 | A1 | 7/2009 | Carruba | |
| 2009/0301521 | A1 | 12/2009 | Field | |
| 2010/0154822 | A1 | 6/2010 | Reed, Jr. et al. | |
| 2010/0287716 | A1 | 11/2010 | Kasper et al. | |
| 2011/0236275 | A1 | 9/2011 | Robertson et al. | |
| 2012/0145191 | A1 | 6/2012 | Williams et al. | |
| 2012/0168971 | A1 | 7/2012 | Hansen et al. | |
| 2013/0319463 | A1 | 12/2013 | Policicchio | |

FOREIGN PATENT DOCUMENTS

| | | | |
|---|---|---|---|
| CN | 101884514 | A | 11/2010 |
| CN | 102037113 | A | 4/2011 |
| CN | 102154068 | A | 8/2011 |
| CN | 102462465 | A | 5/2012 |
| GB | 493075 | | 10/1938 |
| WO | 2001022860 | A1 | 4/2001 |
| WO | 2010037226 | A1 | 4/2010 |
| WO | 2011019814 | A2 | 2/2011 |
| WO | 20120123721 | A1 | 9/2012 |

OTHER PUBLICATIONS

Bissell Steam Mop Deluxe User's Guide, Manual, 2010, 12 pages, Grand Rapids, Michigan, USA, retrieved from http://www.bissell.com/steam-mop-deluxe/ on Mar. 12, 2013.

Bissell Stomp 'n Go, Brochure, 3 pages, 2012, Grand Rapids, Michigan, USA, retrieved from http://www.bissell.com/stomp-n-go/ on Mar. 12, 2013.

Bissell Steam Mop, Manual, 8 pages, 2010, Grand Rapids, Michigan, USA, retrieved from http://www.bissell.com/steam-mop/ on Mar. 12, 2013.

Euro-Pro Shark Steam Mop, Manual, 2007, Plattsburgh, New York, USA, retrieved from http://www.sharkclean.com/Shark-S3101-Steam-Mop/ on Mar. 12, 2013.

Proctor & Gamble Swifter Wet Jet, Brochure, 10 pages, 2012, USA, retrieved from http://www.swiffer.com/products/swiffer-wetjet-mopping-system on Mar. 12, 2013.

Proctor & Gamble Swifter Wet Pad Material Safety Data Sheet, 5 pages, 2008, Cincinnati, Ohio, USA.

Proctor & Gamble Swifter Sweeper Wet Mopping Cloths, Catalog, 2 pages, 2013, USA, retrieved from http://www.homedepot.com/p/t/202689780?catalogId=10053&langId=-1&locStoreNum=6175&productId=202689780&storeId=10051#.UT9q4hw0V8E on Mar. 12, 2013.

Bissell ProHeat™ Clearview® User's Guide, 1699 Series—120V 8905 Series—120V, 24 pages, Jan. 2002, Grand Rapids, Michigan, United States.

Hoover® SteamVac™ Deluxe, The Easy to Use Deep Cleaner, Owner's Manual, 32 pages, 1997, North Canton, Ohio, United States.

Bissell ProHeat™ Pro-Tech®, User's Guide, 7920/7901 Series—8915/8910 Series, 24 pages, Jul. 2003, Grand Rapids, Michigan, United States.

Bissell QuickSteamer®, User's Guide, 1950 Series Quicksteamer—2020 Series Quicksteamer Powerbrush, 12 pages, Feb. 2002, Grand Rapids, Michigan, United States.

Dirt Devil® Featherlite Deluxe Owner's Manual—Operating and Servicing Instructions, 36 pages, Mar. 2002, USA & Canada.

* cited by examiner

SURFACE CLEANING APPARATUS

CROSS-REFERENCE TO RELATED APPLICATION

This application is a continuation of U.S. patent application Ser. No. 13/836,630, filed Mar. 15, 2013, now U.S. Pat. No. 9,420,933, issued Aug. 23, 2016, which claims the benefit of U.S. Provisional Patent Application No. 61/655,289, filed Jun. 4, 2012 and is a continuation-in-part of U.S. application Ser. No. 13/323,286, filed Dec. 12, 2011, now U.S. Pat. No. 8,927,480, issued Jan. 6, 2015, all of which are incorporated herein by reference in their entirety.

BACKGROUND OF THE INVENTION

The invention relates generally to a surface cleaning apparatus with steam delivery. Devices such as steam mops and handheld steamers are configured for cleaning a wide variety of common household surfaces such as bare flooring including tile, hardwood, laminate, vinyl, and linoleum, as well as countertops, stove tops and the like. Typically, steam mops comprise at least one liquid tank or reservoir for storing water that is fluidly connected to a selectively engageable pump or valve. The outlet of the pump or valve is fluidly connected to a steam generator, which comprises a heating element for heating the liquid. The steam generator produces steam, which can be directed towards the surface to be cleaned through a distributor nozzle or a manifold located in a foot or cleaning head that engages the surface to be cleaned. Steam is typically applied to the backside of a cleaning pad that is attached to the cleaning head. Steam eventually saturates the cleaning pad and the damp pad is wiped across the surface to be cleaned to remove dirt, dust, and debris present on the surface. Additionally, auxiliary liquids such as fragrances, detergents or other additives can be supplied via the liquid tank for distribution through the surface cleaning apparatus to improve cleaning efficacy or to provide other sensory benefits.

Some steam appliances locate a removable water supply tank and a steam generating device on an upright handle and deliver steam through a universal joint to a pivoting cleaning foot that is typically covered by a reusable cleaning pad. One example is the BISSELL Steam Mop™ Deluxe (Model 31N1). Details of a similar steam mop device are disclosed in Chinese Patent CN2482956 to Wu. In an alternate configuration, the steam generator can be located on the cleaning head as disclosed in U.S. Pat. No. 6,584,990 to Shaw.

Impregnated cleaning pads and cleaning pads that can also reabsorb liquid from a surface to be are disclosed in U.S. Pat. No. 7,144,173 to Policicchio.

Carpet cleaning compositions for use in extraction machines are also known as disclosed in U.S. Pat. No. 7,718,593 to Micchice. Extraction machines that incorporate an in-line heater can heat the solution to a temperature less than boiling are more fully disclosed in U.S. Pat. No. 6,131,237 to Kasper. Cleaning compositions are stored in a liquid state and are selectively applied to the carpet, optionally agitated, left to dwell, and then removed using suction generated by a separate vacuum motor and fan assembly.

It is also known to combine steam and cleaning compositions to remove stains from textile fabrics as more fully disclosed in U.S. Pat. No. 6,048,368 to Tcheou. This patent teaches applying the cleaning composition on a front side of the textile, pushing the composition through the textile, and then absorbing the excess liquid from the back side of the textile.

BRIEF SUMMARY OF THE INVENTION

In accordance with one aspect of the invention, a surface cleaning apparatus for treating a stain on a floor surface includes a reservoir configured to hold a supply of a solution, a steam generator in fluid communication with the reservoir for heating the solution to at least 212 degrees Fahrenheit (100 degrees Celsius) to generate steam from the solution, a cleaning composition comprising dilute hydrogen peroxide and sodium lauryl sulfate, and at least one steam outlet fluidly connected to the steam generator to deliver steam onto the cleaning composition.

The application of steam to the cleaning composition transfers energy from the steam to the cleaning composition to enhance the cleaning efficacy of the cleaning composition as compared to the cleaning efficacy of the cleaning composition without steam.

DESCRIPTION OF EMBODIMENTS OF THE INVENTION

Figure 1:
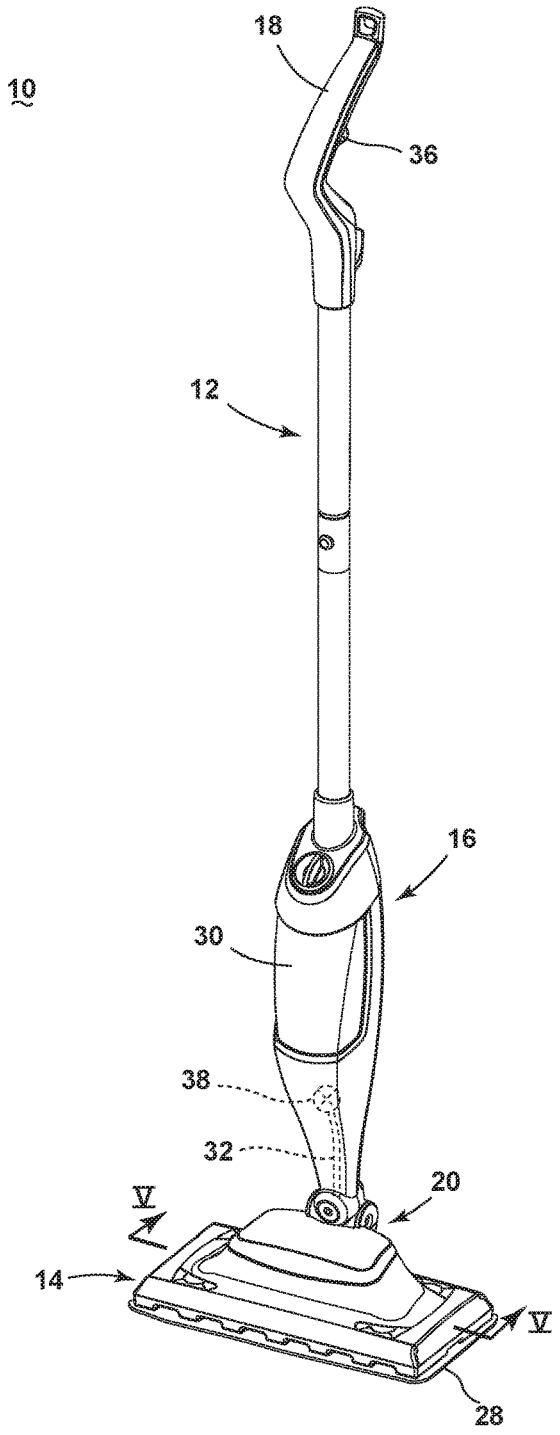
FIG. 1 is a front perspective view of a surface cleaning apparatus in the form of a steam mop according to a first embodiment of the invention.
Figure 2:
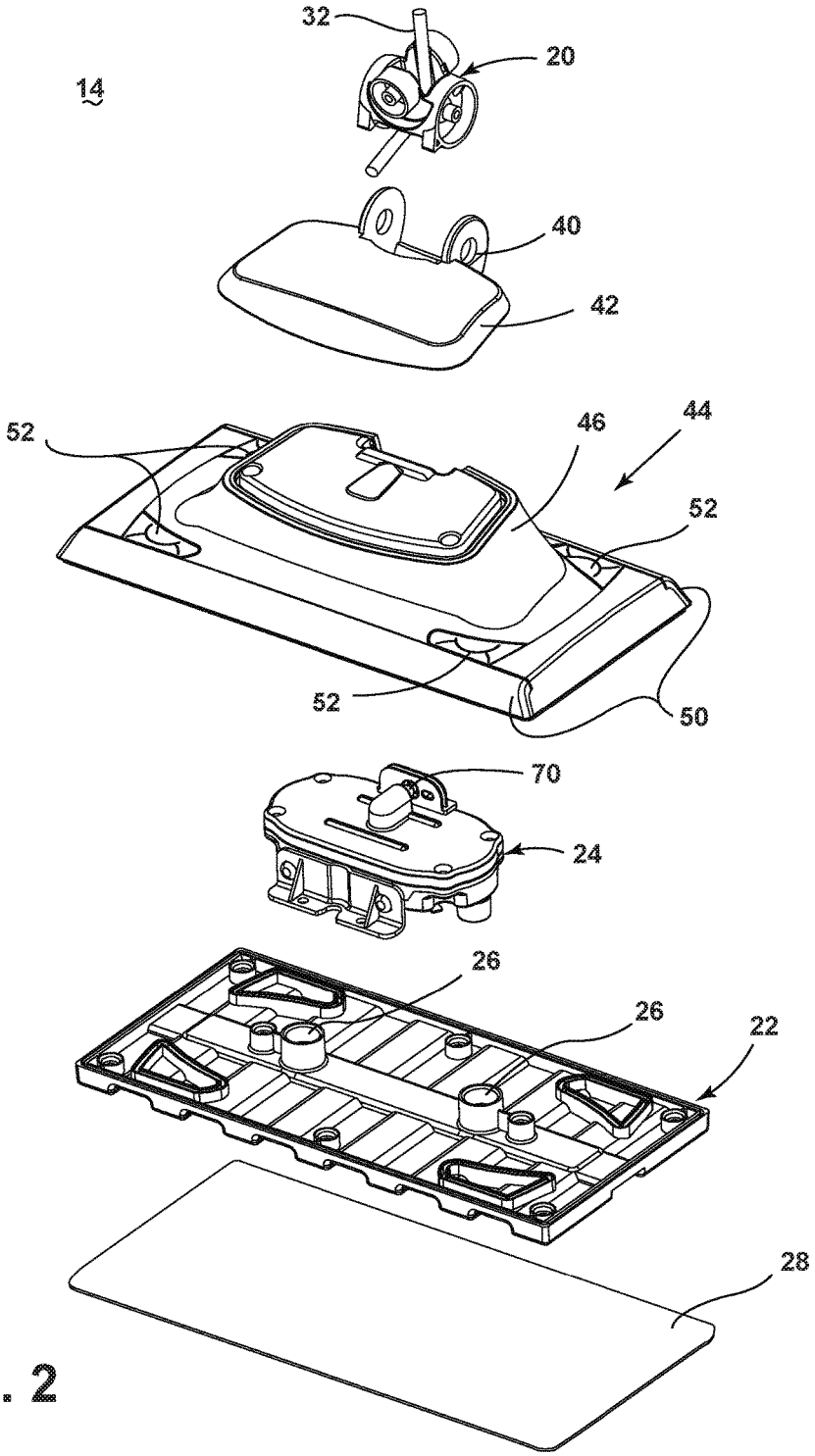
FIG. 2 is an exploded view of a foot portion of the steam mop of FIG. 1.

Referring to FIGS. 1-2, a steam appliance 10 is according to a first embodiment of the invention comprises an upright handle assembly 12 swivelably mounted to a cleaning foot assembly 14. The upright handle assembly 12 further comprises a handle housing 16 located between a handle grip 18 and a universal joint 20. The cleaning foot assembly 14 is attached to the universal joint 20 and further comprises a steam frame 22, a steam generator 24, and at least one steam outlet 26. A cleaning pad assembly 28 is removably attached to a lower surface of the steam frame 22.

The handle housing 16 further accommodates a portion of a fluid delivery system comprising a cleaning solution reservoir 30 that is configured to distribute cleaning solution to downstream portions of the fluid delivery system as is commonly known in the art. A solution conduit 32 fluidly connects the cleaning solution reservoir 30 through the universal joint 20 to convey liquid cleaning solution to the steam generator 24. A steam conduit 86 (FIG. 5) fluidly connects the steam generator 24 to the steam outlet 26 whereby steam generated by the steam generator 24 is delivered to a top surface of the cleaning pad assembly 28. A trigger 36 is pivotally mounted to the handle grip 18 and is accessible for selective engagement by a user. The trigger 36 is operably connected to an upper end of a push rod (not shown) that is slidably mounted within the handle housing 16. A bottom end of the push rod is in register with a valve 38 that is fluidly connected between the solution conduit 32 and steam generator 24 for selectively controlling flow of solution from the cleaning solution reservoir 30 to the steam generator 24. A suitable steam generator is more fully described in U.S. Pat. No. 6,584,990 to Shaw which is incorporated herein by reference in its entirety. Moreover, additional examples of steam mops, steam mop pads and cleaning methods that may be used with embodiments of the invention described herein include the BISSELLSteam Mop™, sold in the United States by BISSELL Homecare, Inc., International Application No. PCT/US10/45167, filed Aug. 11, 2010, titled "Upright Steam Mop with Auxiliary Hand Tool," now WO2011/019814, published Feb. 17, 2011, U.S. application Ser. No. 12/778,615, filed May 12, 2010, titled "Upright Steam Mop Sweeper," now U.S. Pat. No. 8,458,850, issued Jun. 11, 2013, U.S. application Ser. No. 13/788,957, filed Mar. 7, 2013, titled "Surface Cleaning Apparatus," now U.S. Pat. No. 9,320,405, issued Apr. 26, 2016, and U.S. application Ser. No. 13/323,286, filed Dec. 12, 2011, titled "Cleaning Cloth with Encapsulated Formulation, Steam Mop and Method," now U.S. Pat. No. 8,927,480, issued Jan. 6, 2015, all of which are assigned to BISSELL Homecare Inc. and which are herein incorporated by reference in their entirety.

FIG. 2 is a partial exploded view of the cleaning foot assembly 14. The universal joint 20 is pivotally mounted to corresponding bosses 40 on the upper rear portion of a top cap 42. The universal joint 20 is configured to rotate back and forth about a first horizontal axis that extends laterally through the sides of the steam mop, and from side to side about a second horizontal axis that extends from front to back, orthogonal to the first axis. The top cap 42 is mounted on top of a cover 44, which is fastened to the top of the steam frame 22.

The cover 44 comprises a generally rectangular housing with a raised central portion 46, which forms a cavity 48 (FIG. 5) when the cover 44 is mounted to the steam frame 22, the cavity 48 being adapted to receive the steam generator 24 therein. The cover 44 further comprises elongate bumpers 50 that span the front and rear sides thereof. The bumpers 50 can comprise an elastomeric, non-marring material and can be over-molded or otherwise fastened to the cover 44. The cover 44 can further comprise sheet retainers 52 that are configured to hold a portion of the cleaning pad assembly 28 or cleaning sheet in register with the foot assembly 14, as is commonly known in the art.

Figure 3:
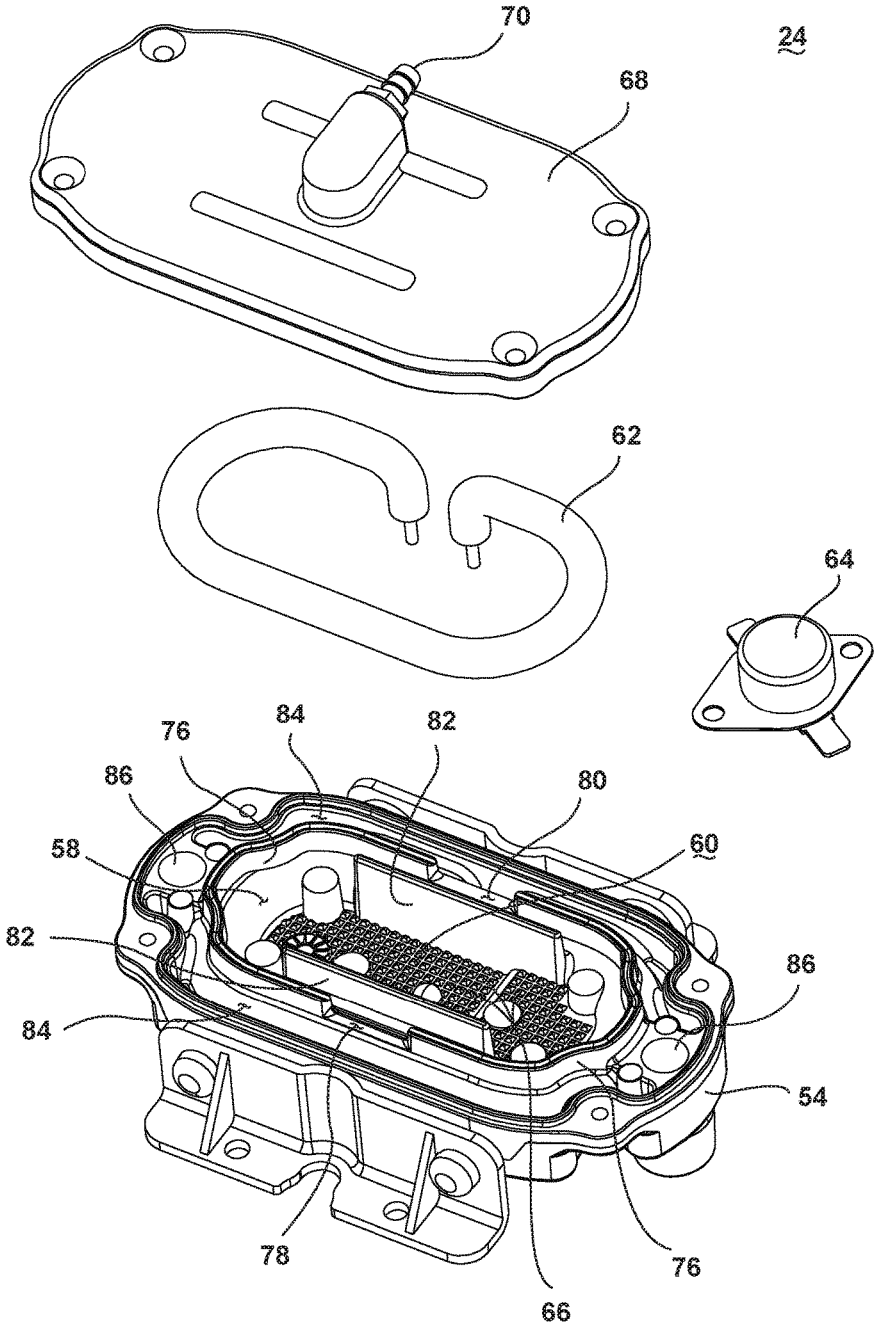
FIG. 3 is a partial exploded view of a steam generator of the steam mop of FIG. 1.

FIG. 3 is a partial exploded view of the steam generator 24. The steam generator 24 is configured for connection to an electrical power source, such as a residential power supply via a power cord (not shown), or to a cordless power supply, such as batteries. The steam generator 24 comprises a heater block 54 with an open top, and a recessed cavity 58 therein, which defines a fluid drip heating surface 60. An electrical heating element 62 is mounted within the bottom of the heater block 54, beneath and in thermal register with the back of the fluid drip heating surface 60. A thermostat 64 can be connected to the heating element 62 and adapted to regulate its operational temperature based on predetermined desired performance criteria. When the steam generator 24 is energized and the heating element 62 is at operating temperature, the fluid drip heating surface 60 is adapted to flash heat liquid droplets and convert the liquid into steam. A steam cover 68 is adapted to be sealingly fastened to the open top of the heater block 54.

Figure 4:
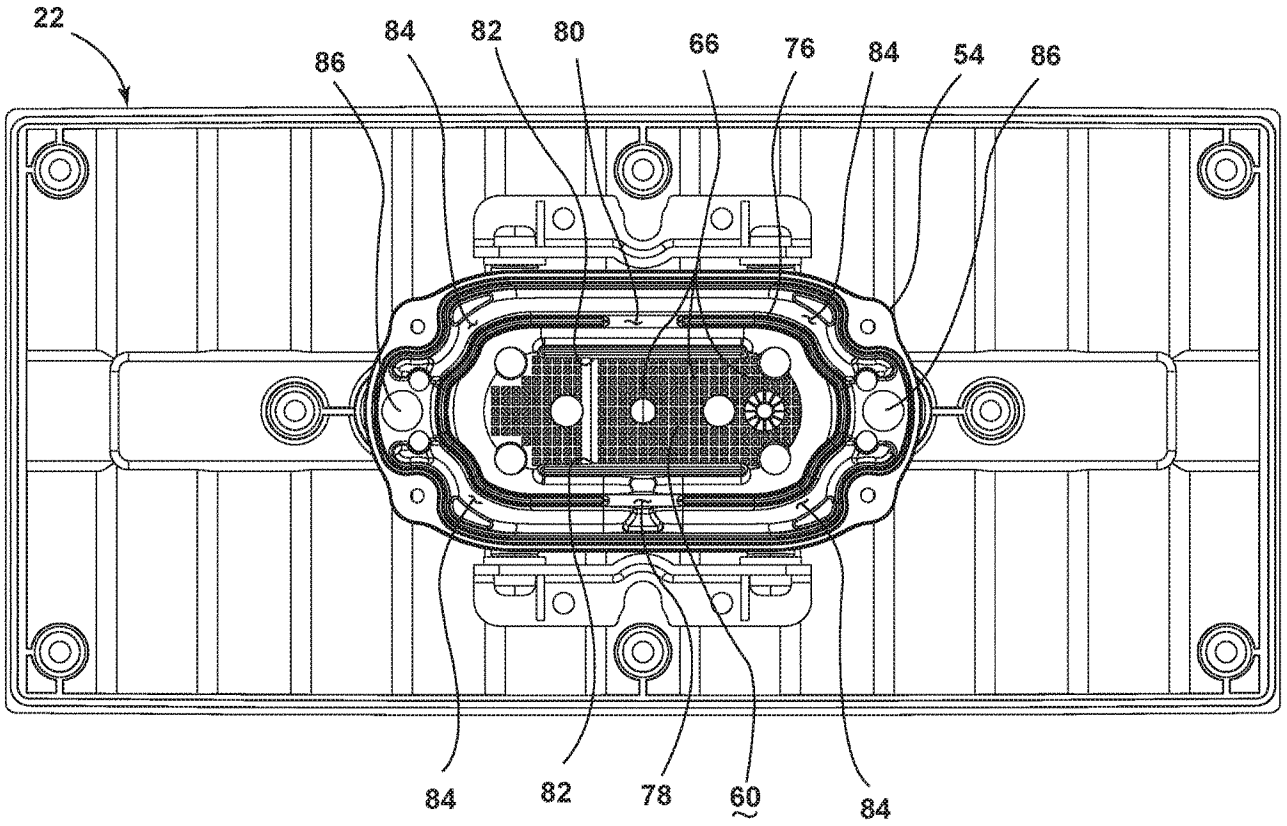
FIG. 4 is top view of the foot assembly of the steam mop of FIG. 1, with some components of the foot assembly removed for clarity.

As illustrated for exemplary purposes, and as best shown in FIG. 4, which is a top view of the foot assembly 14 with several components such as the top cap 42, the cover 44, and the steam cover hidden for clarity and to reveal the inside portion of the steam generator 24, the fluid drip heating surface 60 can comprise a plurality of projections 66, which are adapted to increase the surface area of the fluid drip heating surface 60. Alternatively, the fluid drip heating surface 60 can be textured, flat, convex, concave or undulating. The fluid drip heating surface 60 can further comprise a top layer or coating adapted to impart corrosion resistance or reduce friction. For example, the coating can comprise polytetrafluoroethylene (PTFE), or other suitable materials to improve dispersion of liquid and to minimize corrosion or build-up of residue on the heating surface.

Figure 5:
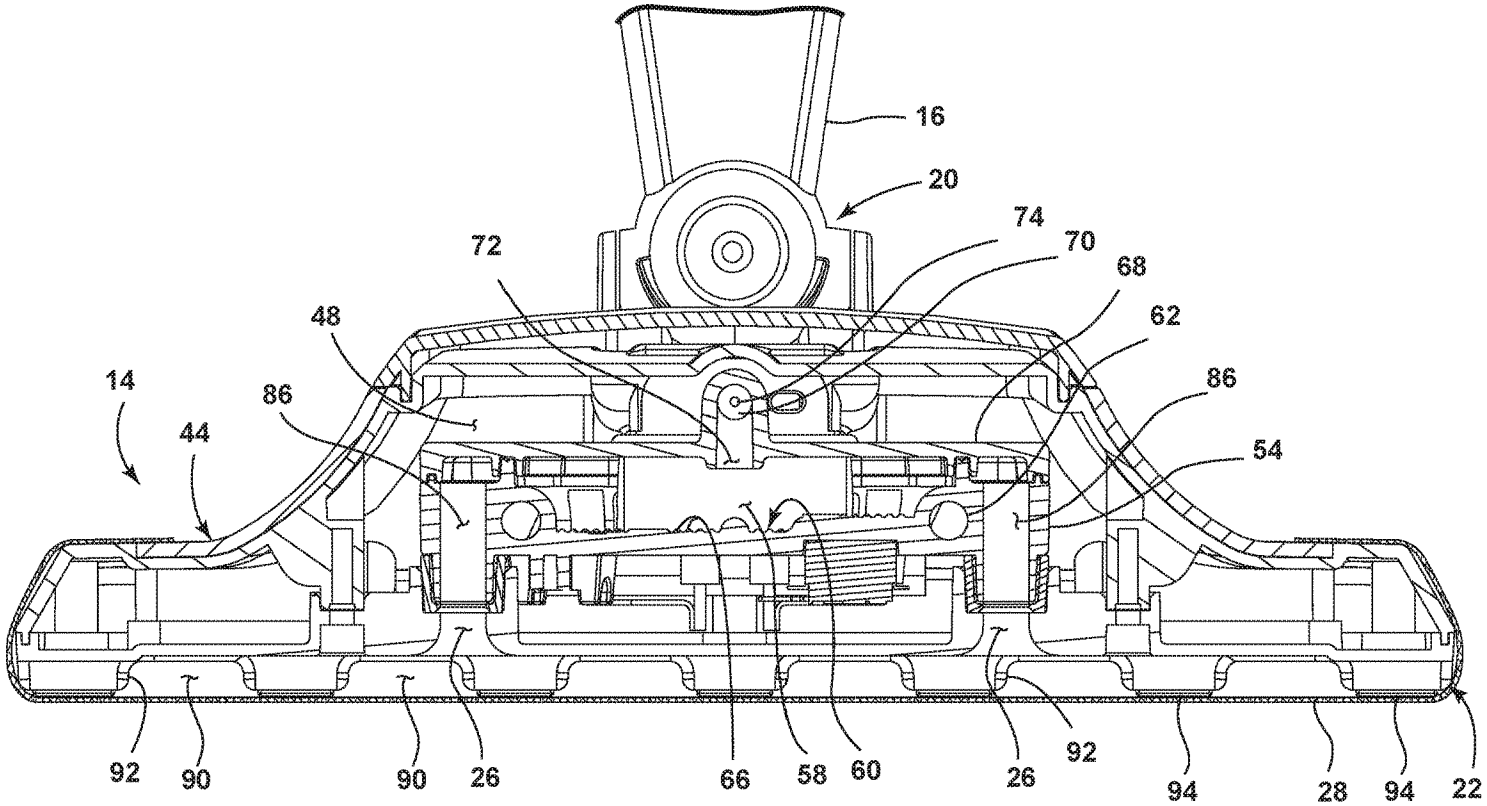
FIG. 5 is a cross-sectional view of the steam mop of FIG. 1 taken along line V-V of FIG. 1.

Referring to FIG. 5, which is a cross-sectional view of the cleaning foot assembly 14 taken through line V-V of FIG. 1, the steam cover 68 is adapted to be sealingly fastened to the open top of the heater block 54. The steam cover 68 further comprises a liquid inlet 70 that is fluidly connected to a liquid outlet 72, which is located above and in fluid communication with the fluid drip heating surface 60 when the steam cover 68 is mounted to the heater block 54. The liquid inlet 70 can further comprise an orifice restrictor 74 for limiting the volume of liquid flow therethrough, into the recessed cavity 58 and onto the fluid drip heating surface 60. The liquid inlet 70 is fluidly connected to the solution conduit 32 (FIG. 2). The joint between the steam cover 68 and the heater block 54 can be leak-proof. As illustrated for exemplary purposes, the joint can comprise a tongue and groove joint. Alternatively, one or more gaskets can be compressed between the steam cover 68 and the heater block 54 to prevent leakage of liquid or steam through the joint.

Referring to FIGS. 3 and 4, a steam barrier wall 76 extends upwardly from the perimeter of the recessed cavity 58 and is configured to sealingly mate with the bottom of the steam cover 68. Opposed front and rear steam cavity outlet slots 78, 80 are formed along a front and rear portion of the steam barrier wall 76, respectively. Opposed steam baffle ribs 82 extend upwardly from the fluid drip heating surface 60, and are located parallel to and inboard to the front and rear portions of the steam barrier wall 76. The steam baffle ribs 82 extend beyond the width of the front and rear steam cavity outlet slots 78, 80, but are offset therefrom and thus form a torturous steam flow path from the cavity 58, through the front and rear steam cavity outlet slots 78, 80. The front and rear steam cavity outlet slots 78, 80 are in fluid communication with a recessed steam channel 84 that extends around the upper perimeter of the heater block 54 and which is further defined between the steam barrier wall 76 and the outer surface of the heater block 54. At least one steam conduit 86 can be formed in the heater block 54 and fluidly connects the steam channel 84 to the at least one steam outlet 26 formed in the bottom wall of the steam frame 22 (FIG. 2). As shown herein, steam conduits 86 are formed at each side of the heater block 54 and each steam conduit 86 fluidly connects the steam channel 84 to a corresponding steam outlet 26.

With reference to FIGS. 2 and 5, the steam frame 22 comprises a generally rectangular housing having two spaced steam outlets 26 in a bottom wall thereof. The bottom wall further comprises a plurality of steam delivery channels 90 that are fluidly connected to the steam outlets 26 for distributing steam to the top side of the cleaning pad assembly 28 or cleaning sheet. A plurality of support pads 92, which protrude from the bottom of the steam frame 22 and define the steam delivery channels 90 therebetween, can further comprise gripping members 94 that are adapted to contact the cleaning pad assembly 28 or cleaning sheet and prevent the pad or sheet from slipping relative to the steam frame 22. For exemplary purposes, the gripping members 94 have been illustrated as high friction, elastomeric strips, however, other configurations are possible such as hook and loop fasteners, for example.

The cleaning pad assembly 28 can comprise a non-woven pad optionally impregnated with a specially formulated cleaning composition. In one suitable embodiment, the pad 28 is composed of 100% meltblown polypropylene with a tensile strength of 16,294 in the machine direction (MD) and 11,721 in the cross direction (CD). The pad 28 has a basis weight of 340 grams/square meter or 10.0 OSY with an absorbency of up to 13 times itself per pad.

According to one aspect of the invention, stains on a surface can be treated using a combination of a peroxygen, a surfactant, and steam. Cleaning compositions can be tailored to remove specific stains, however compositions that include a dilute hydrogen peroxide component in combination with an anionic detergent that includes a surfactant such as sodium lauryl sulfate have been found to be effective in removing stubborn stains from nylon carpet fibers when exposed to steam.

It has been found that surprising results occur when the cleaning compositions described herein are heated at the point of delivery through the use of steam. Steam releases a predictable and precise amount of energy to the composition at the surface to be cleaned as it changes from a gaseous state to a liquid state. This energy is transferred to the cleaning composition to enhance the cleaning efficacy. When a combination of a peroxygen, a surfactant, and steam is applied to the surface to be cleaned, stains are effectively removed. In one example, in which a stain is on a surface comprising a carpet, the surfactant, such as sodium lauryl sulfate, mobilizes the stain in the carpet, which is subsequently at least partially destroyed by the peroxygen, such as hydrogen peroxide, through an oxidation reaction. The heat and moisture from the application of steam provides energy for the oxidation reaction and aids in mobilization of the stain. The stain may be fully destroyed by the peroxygen. Any remaining stain that is not destroyed may be absorbed along with any excess cleaning composition and moisture, by the cleaning pad 28. Alternate means can also be used to remove excess cleaning composition and moisture, such as a known carpet extraction device as more fully disclosed in U.S. Pat. No. 6,131,237 to Kasper which is incorporated herein by reference in its entirety. After the stain removal process, the stain is no longer visible on the carpet to the user, and does not reappear later.

Particularly, stubborn stains involving red dye #40 that have not been appreciably loosened by either steam alone, hydrogen peroxide compositions alone, sodium lauryl sulfate compositions alone, or mixed compositions containing hydrogen peroxide and sodium lauryl sulfate, are effectively removed with the combination of steam, hydrogen peroxide, and sodium lauryl sulfate.

The cleaning composition can be impregnated into the cleaning pad assembly 28. The cleaning composition can optionally be encapsulated in the cleaning pad assembly 28 as disclosed in U.S. patent application Ser. No. 13/323,286, now U.S. Pat. No. 8,927,480, issued Jan. 6, 2015, which is incorporated by reference herein in its entirety. Alternatively, the cleaning pad 28 can comprise a generally flat disposable pad or sheet, with the cleaning composition applied directly to the floor or indirectly by dispensing the cleaning composition through the cleaning pad 28.

The cleaning composition can comprise hydrous or anhydrous configurations or combinations thereof. In one example of a hydrous cleaning composition, the cleaning pad assembly 28 can be pre-moistened with a liquid peroxygen and surfactant solution. For example, the cleaning pad assembly 28 can be impregnated with a liquid hydrogen peroxide and sodium lauryl sulfate solution.

Alternatively, the cleaning composition can comprise a soluble anhydrous composition. For example, the composition can include a mixture of a solid, soluble peroxygen component, in combination with a solid, soluble anionic detergent that includes a surfactant such as sodium lauryl sulfate in soluble solid or powder form. The solid peroxygen component can comprise sodium perborate, sodium percarbonate, calcium percarbonate, or a solid complex of hydrogen peroxide with polyvinylpyrrolidone (commercially available from Ashland Inc. as Peroxydone™), for example.

Surfactants other than anionic detergents can also be used, such as cationic, nonionic, zwitterionic or amphoteric detergents, or combinations thereof, regardless of whether the composition is hydrous or anhydrous. The use of anionic, cationic, nonionic, zwitterionic or amphoteric detergents can produce difference surface finishes when dry.

The anhydrous composition can be impregnated or otherwise provided on or in the pad assembly 28 such as by encapsulating the composition within soluble polyvinyl alcohol (PVA) film or in a soluble tablet or disk that can be attached to the cleaning pad or placed directly onto the surface to be cleaned, for example.

In operation, the steam appliance 10 of FIGS. 1-5 is used to effectively remove a stain from the surface to be cleaned. The cleaning pad assembly 28 impregnated with one of the cleaning compositions described herein is attached to a lower surface of the steam frame 22 over the steam outlets 26. The cleaning solution reservoir 30 is filled with water and reinserted on the handle housing 16. The steam appliance is taken to the area with the stain and the unit is plugged in to a conventional electrical outlet. Electricity flows to the steam generator 24 which heats water flowing through the solution conduit 32 to 212 degrees Fahrenheit to produce steam. The pressurized steam exits the steam frame 22 at the steam outlets 26 and passes through the cleaning pad assembly 28. As steam passes through the cleaning pad assembly 28, a portion of the impregnated cleaning composition is carried with the steam to the surface to be cleaned. To treat a stain, the cleaning composition can be allowed to dwell on the surface for a specified period of time, such as 2-5 minutes, at which point the stain has been mobilized and at least partially destroyed, as described above. Excess cleaning composition, along with any stain that may remain, is then absorbed by the cleaning pad assembly 28 or other means as previously described herein. Other debris on the surface to be cleaning can also be absorbed by the cleaning pad assembly 28.

If an anhydrous composition is applied to the pad assembly 28, the steam appliance 10 can be energized and placed on the surface to be cleaned as previously described. However, steam and moisture from the steam appliance 10 solubilize the anhydrous composition and transform the soluble solid particles or powder into a commingled liquid slurry comprising the cleaning composition, which is carried by the steam through the cleaning pad assembly 28 and onto the stain. To treat the stain, the cleaning composition can be allowed to dwell on the surface for a specified period of time, such as 2-5 minutes, at which point the stain has been mobilized and at least partially destroyed, as described above. Excess cleaning composition, along with any stain that may remain, is then absorbed by the cleaning pad assembly 28 or other means as previously described herein.

Other debris on the surface to be cleaning can also be absorbed by the cleaning pad assembly 28.

Alternatively, the anhydrous composition can be applied directly to a stain the surface to be cleaned and the steam appliance 10 can be energized and placed on the surface to be cleaned, with the cleaning pad assembly 28 placed directly over the stain pre-applied with the anhydrous composition. Steam and moisture from the steam appliance 10 solubilize the anhydrous composition and transform the soluble solid particles or powder into a commingled liquid slurry comprising the cleaning composition, which is carried by the steam through the cleaning pad 28 and onto the stain. To treat the stain, the cleaning composition can be allowed to dwell on the surface for a specified period of time, such as 2-5 minutes, at which point the stain has been mobilized and at least partially destroyed, as described above. Excess cleaning composition, along with any stain that may remain, is then absorbed by the cleaning pad assembly 28 or other means as previously described herein. Other debris on the surface to be cleaning can also be absorbed by the cleaning pad assembly 28.

Laboratory testing illustrates the surprising cleaning results achieved by combining steam with a pre-moistened cleaning pad, even without the presence of a peroxygen component. Three different appliances were used to clean four different stains on white vinyl tiles. The appliances included the commercially available EuroPro Shark Steam Mop, the commercially available Procter and Gamble Swiffer Wet Jet, and the steam appliance 10 as embodied in FIGS. 1-5. It is noted that the Swiffer Wet Jet dispenses liquid, while the EuroPro Shark Steam Mop and steam appliance 10 dispense steam. The EuroPro Shark Steam Mop and the Swiffer Wet Jet were tested using the dry pads supplied with the devices. Further comparisons were made between pad types used on the steam appliance 10 as embodied in FIGS. 1-5. Four commercially available dry steam mop pads of varying thicknesses were used on the steam appliance 10, including 80 gram pads, 150 gram pads, 180 gram pads, and a plush Bonnet pad identified as P351. One commercially available wet pad, the Proctor and Gamble Swiffer Sweeper Wet Mopping cleaning pad, which contains surfactants, was used on the steam appliance 10. The identified stains were evenly applied and allowed to dry. Testing of the various combinations of appliances and cleaning pads was completed by moving the appliance with pad over the stain for a total of 6 strokes. Visual observations were made and a subjective evaluation was recorded on a scale of 1-5 with 5 being completely clean and 1 appearing virtually untouched. The results are provided in Table 1 and clearly illustrate the cleaning advantage of the steam appliance 10 of FIGS. 1-5 with a pre-moistened cleaning pad over using a steam appliance or a liquid dispensing appliance with a dry pad.

TABLE 1

| Manufacturer | Unit Type | Pad Type | Spaghetti Sauce | BBQ Sauce | Catsup | Olive Oil |
|---|---|---|---|---|---|---|
| Shark | Steam Mop (Model S3101) | Dry (As supplied) | 2 | 2 | 1.5 | 2 |
| Swiffer | Wet Jet (Model 32694) | Dry (As supplied) | 3 | 3 | 2 | 3 |
| BISSELL | Steam appliance 10 | Dry (80 gram) | 2 | 1.5 | 2 | 2 |

TABLE 1-continued

| Manufacturer | Unit Type | Pad Type | Spaghetti Sauce | BBQ Sauce | Catsup | Olive Oil |
|---|---|---|---|---|---|---|
| BISSELL | Steam appliance 10 | Dry (150 gram) | 2 | 4 | 3 | 2 |
| BISSELL | Steam appliance 10 | Dry (180 gram) | 3 | 2 | 2 | 4 |
| BISSELL | Steam appliance 10 | Wet (Swiffer Wet Mopping pad) | 4 | 5 | 4 | 4 |
| BISSELL | Steam appliance 10 | Dry (P351 Bonnet pad) | 3 | 4 | 3 | — |

Further testing was conducted to evaluate the impact of combining steam with a cleaning composition comprising water, a detergent further comprising a surfactant including sodium lauryl sulfate, and optionally a fragrance on removing a red dye stain from carpet fibers. Generally, a commercially available BISSELL Stomp N Go (Model 96Q9W) pre-moistened cleaning pad comprising a composition including hydrogen peroxide and sodium lauryl sulfate was modified by removing the impermeable top layer. Specifically, the cleaning composition had ratio of 1:1.15 sodium lauryl sulfate to hydrogen peroxide. The pad was placed over a red dye stain on a carpet sample and allowed to dwell for approximately two to five minutes. A commercially available BISSELL Steam Mop was placed over the Stomp & Go pad and steam was discharged through the pad. When the Steam Mop was removed, it was observed that the red dye stain was no longer visible on the carpet fibers, and any excess cleaning composition was absorbed into the modified Stomp n Go pad. The process was found to work equally well on a variety of carpet stains and discolorations.

In an alternate embodiment, a second solution reservoir can be added to the handle housing 16 along with a separate solution conduit to deliver the cleaning composition described herein directly to the floor via a dedicated spray tip as is commonly known in the art. A suitable auxiliary spray system is described in conjunction with a wet mop device in U.S. Pat. No. 7,048,804 to Kisela which is incorporated herein by reference in its entirety. In this embodiment, the steam appliance 10 effectively serves its customary function as an effective bare floor cleaner as disclosed in U.S. Pat. No. 6,584,990 to Shaw or the BISSELL Steam Mop. When stains on carpeted surfaces are observed, the steam appliance 10 can be taken to the stained area and pre-wetted with cleaning composition contained in the second solution tank. Once the stain is pre-wetted, the cleaning pad assembly 28 is placed over the pre-wetted area, steam is delivered to the treated stain, the stain is effectively removed from the carpet fibers, and the excess cleaning solution is absorbed by the cleaning pad assembly 28 as previously disclosed.

Optionally, the composition can be applied directly to a stain to be cleaned via an auxiliary distributor such as a conventional manual sprayer or pressurized dispenser, for example. When a stain on a carpeted surface is observed, a user can distribute the cleaning composition onto the stained area using the auxiliary distributor to wet the surface. Next, the steam appliance 10 can be energized and placed on the surface to be cleaned, with a substantially dry cleaning pad assembly 28 on the steam appliance 10 placed directly over the stain pre-wetted with the cleaning composition. To treat the stain, the cleaning composition can be allowed to dwell on the surface for a specified period of time, such as 2-5 minutes, at which point the stain has been mobilized and at least partially destroyed, as described above. Excess cleaning composition, along with any stain that may remain, is then absorbed by the cleaning pad assembly 28 or other means as previously described herein. Other debris on the surface to be cleaning can also be absorbed by the cleaning pad assembly 28.

While the invention has been specifically described in connection with certain specific embodiments thereof, it is to be understood that this is by way of illustration and not of limitation, and the scope of the appended claims should be construed as broadly as the prior art will permit. For example, it will be apparent that the invention is not limited to steam mop floor cleaning machines of various configurations, but is equally applicable to, for example, extraction cleaning machines having fluid delivery and recovery tanks, where the extraction cleaning machine is modified to include a steam delivery function as described above. Representative examples of extraction cleaning machines are disclosed in U.S. Pat. Nos. 5,500,977 and 6,658,692, which are incorporated by reference herein in their entirety. In addition, the invention is also equally applicable to wet mops having a fluid delivery tank as disclosed, for example, in U.S. Pat. No. 7,048,458, which is also incorporated herein in its entirety, where the wet mop is modified to include a steam delivery function as described above.

What is claimed is:

1. A surface cleaning apparatus for treating a stain on a floor surface, the surface cleaning apparatus comprising:

a first reservoir configured to hold a supply of a solution;

a steam generator in fluid communication with the first reservoir for heating the solution to at least 212 degrees Fahrenheit (100 degrees Celsius) to generate steam from the solution;

a cleaning pad positioned to contact the stain on the floor surface and comprising a cleaning composition comprising dilute hydrogen peroxide and sodium lauryl sulfate; and at least one steam outlet fluidly connected to the steam generator to deliver steam onto the cleaning pad to heat the cleaning composition;

wherein the cleaning composition comprises a ratio of 1:1.15 sodium lauryl sulfate to hydrogen peroxide.

2. The surface cleaning apparatus of claim 1 and further comprising a foot movable along a surface to be cleaned and an upright housing coupled to the foot, wherein the cleaning pad is mounted on a lower surface of the foot.

3. The surface cleaning apparatus of claim 1 and further comprising a pad frame movable along a surface to be cleaned and a handle operably coupled to the pad frame, wherein the cleaning pad is mounted on the pad frame.

4. The surface cleaning apparatus of claim 3 and further comprising a cover mounted to the pad frame and defining a cavity which receives the steam generator.

5. The surface cleaning apparatus of claim 1, wherein the cleaning pad is composed of 100% meltblown polypropylene.

6. The surface cleaning apparatus of claim 1, wherein the cleaning composition further comprises a fragrance.

7. The surface cleaning apparatus of claim 1, wherein cleaning composition comprises a hydrous cleaning composition, and the cleaning pad is pre-moistened with the hydrous cleaning composition.

8. The surface cleaning apparatus of claim 1, wherein cleaning composition comprises a soluble anhydrous cleaning composition.

9. The surface cleaning apparatus of claim 1, wherein the cleaning composition is one of embedded in the cleaning pad, impregnated in the cleaning pad, encapsulated within a soluble film, or provided within a soluble tablet.

10. The surface cleaning apparatus of claim 1, wherein the steam generator is configured to apply steam to the cleaning composition at the time of delivery of the cleaning composition to the stain or subsequent to the delivery of the cleaning composition to the stain.

11. A surface cleaning apparatus for treating a stain on a floor surface, the surface cleaning apparatus comprising:

a first reservoir configured to hold a supply of a solution;

a second reservoir;

a steam generator in fluid communication with the first reservoir for heating the solution to at least 212 degrees Fahrenheit (100 degrees Celsius) to generate steam from the solution;

at least one steam outlet fluidly connected to the steam generator to deliver steam onto the stain on the floor surface;

a cleaning pad positioned to contact the stain on the floor surface; and a cleaning composition in the second reservoir comprising dilute hydrogen peroxide and sodium lauryl sulfate;

wherein the steam generator is configured to apply steam to the cleaning composition at the time of delivery of the cleaning composition to the stain or subsequent to the delivery of the cleaning composition to the stain and wherein the cleaning composition comprises a ratio of 1:1.15 sodium lauryl sulfate to hydrogen peroxide.

12. A surface cleaning apparatus for treating a stain on a floor surface, the surface cleaning apparatus comprising:

a first reservoir configured to hold a supply of a solution;

a second reservoir;

a steam generator in fluid communication with the first reservoir for heating the solution to at least 212 degrees Fahrenheit (100 degrees Celsius) to generate steam from the solution;

at least one steam outlet fluidly connected to the steam generator to deliver steam onto the stain on the floor surface;

a cleaning composition in the second reservoir comprising a ratio of 1:1.15 sodium lauryl sulfate to hydrogen peroxide and a fragrance;

wherein the steam generator is configured to apply steam to the cleaning composition at the time of delivery of the cleaning composition to the stain or subsequent to the delivery of the cleaning composition to the stain.

13. The surface cleaning apparatus of claim 11 and further comprising a foot movable along a surface to be cleaned and an upright housing coupled to the foot, wherein the cleaning pad is mounted on a lower surface of the foot.

14. The surface cleaning apparatus of claim 13, wherein the second reservoir is provided on the upright housing.

15. The surface cleaning apparatus of claim 13 and further comprising a spray tip fluidly coupled with the second reservoir to deliver the cleaning composition onto the stain on the floor surface.

16. The surface cleaning apparatus of claim 15 and further comprising a spray tip fluidly coupled with the second reservoir to deliver the cleaning composition onto the stain on the floor surface.

* * * * *